US010022793B2

(12) United States Patent
Yamamoto et al.

(10) Patent No.: US 10,022,793 B2
(45) Date of Patent: Jul. 17, 2018

(54) ALLOY FLAKE PRODUCTION APPARATUS AND PRODUCTION METHOD FOR RAW MATERIAL ALLOY FLAKES FOR RARE EARTH MAGNET USING THE APPARATUS

(75) Inventors: Kazuhiro Yamamoto, Wakayama (JP); Shigeharu Watanabe, Hanoi (VN)

(73) Assignee: SANTOKU CORPORATION, Hyogo (JP)

( * ) Notice: Subject to any disclaimer, the term of this patent is extended or adjusted under 35 U.S.C. 154(b) by 488 days.

(21) Appl. No.: 14/117,115

(22) PCT Filed: May 11, 2012

(86) PCT No.: PCT/JP2012/003106

§ 371 (c)(1),
(2), (4) Date: Nov. 12, 2013

(87) PCT Pub. No.: WO2012/153544

PCT Pub. Date: Nov. 15, 2012

(65) Prior Publication Data

US 2014/0251509 A1 Sep. 11, 2014

(30) Foreign Application Priority Data

May 12, 2011 (JP) ..... 2011-107106

(51) Int. Cl.
*B22F 1/00* (2006.01)
*B22F 9/04* (2006.01)
*H01F 1/057* (2006.01)

(52) U.S. Cl.
CPC ..... *B22F 1/0085* (2013.01); *B22F 1/0055* (2013.01); *B22F 9/04* (2013.01); *H01F 1/0571* (2013.01)

(58) Field of Classification Search
CPC ..... B22F 1/0055; B22F 1/0085; B22F 9/04; H01F 1/0571
(Continued)

(56) References Cited

U.S. PATENT DOCUMENTS 5,382,002 A * 1/1995 Evans ..... B09C 1/06 266/173
5,395,463 A * 3/1995 Johnen ..... B22F 1/0088 148/513
(Continued)

FOREIGN PATENT DOCUMENTS

JP 61-193109 12/1986
JP 03-223401 10/1991
(Continued)

OTHER PUBLICATIONS

Kenji et al.,JP 2004-143595, Raw material alloy for rare earth magnet, production method, and alloy powder for rare earth magnet, May 20, 2014, p. 1-14.*

*Primary Examiner* — Scott Kastler
*Assistant Examiner* — Michael Aboagye
(74) *Attorney, Agent, or Firm* — Clark & Brody

(57) ABSTRACT

An alloy flake production apparatus (1) includes a crystallinity control device (2) for controlling an alloy crystal structure of fed alloy flakes to a desired state, a cooling device (3) for cooling the alloy flakes discharged from the crystallinity control device (2), and a chamber for keeping these devices under reduced pressure or under an inert gas atmosphere. The crystallinity control device (2) has a rotary heating drum (21) in a cylindrical shape for heating the fed alloy flakes, and a switching device (23) for switching between storage and discharge of the alloy flakes fed to an inner wall side of the heating drum (21), so that long-time heat treatment is uniformly applied to the alloy flakes immediately after being made by ingot crushing. The heating drum (21) preferably has a scooping blade plate (22) for scooping up alloy flakes fed to the inner wall side with its rotation.

4 Claims, 1 Drawing Sheet

(58) Field of Classification Search
USPC ..... 148/513; 266/250, 252; 432/80, 106
See application file for complete search history.

(56) References Cited

U.S. PATENT DOCUMENTS

| | | | | |
|---|---|---|---|---|
| 2001/0015350 | A1* | 8/2001 | Morgan | F27B 7/06 219/389 |
| 2013/0112141 | A1* | 5/2013 | Kuniyoshi | B22F 3/24 118/724 |
| 2013/0142687 | A1* | 6/2013 | Onimura | B22D 11/001 420/83 |

FOREIGN PATENT DOCUMENTS

| | | | | |
|---|---|---|---|---|
| JP | 2001-198664 | | 7/2001 | |
| JP | 2002-519613 | | 7/2002 | |
| JP | 2004-143595 | | 5/2004 | |
| JP | 2004143595 | * | 5/2004 | B22F 1/0085 |
| JP | 2005-118850 | | 5/2005 | |
| JP | 2005-193295 | * | 7/2005 | B22F 1/0085 |
| JP | 2005-281755 | | 10/2005 | |
| JP | 2008-127648 | | 6/2008 | |
| JP | 2010-117075 | | 5/2010 | |

* cited by examiner

ALLOY FLAKE PRODUCTION APPARATUS AND PRODUCTION METHOD FOR RAW MATERIAL ALLOY FLAKES FOR RARE EARTH MAGNET USING THE APPARATUS

TECHNICAL FIELD

The present invention relates to an alloy flake production apparatus for applying, to alloy flakes, heat treatment in which the alloy flakes are heated to a predetermined temperature, held at the predetermined temperature for a predetermined time, and then cooled; and a production method for raw material alloy flakes for a rare earth magnet using the apparatus. More specifically, the present invention relates to an alloy flake production apparatus capable of applying long-time heat treatment to alloy flakes immediately after being made by crushing an ingot, and a production method for raw material alloy flakes for a rare earth magnet using the apparatus.

BACKGROUND ART

In recent years, as alloys for rare-earth magnets, there have been R-T-B type alloys with excellent magnetic properties. Here, "R" in the "R-T-B type alloys" represents rare-earth elements, "T," transition metals in which Fe is indispensable, and "B," boron.

Alloy flakes of the R-T-B type alloys can be produced by the following steps.

(a) An ingot in a thin strip shape with a thickness of 0.01 to 2 mm is cast from a molten R-T-B type alloy through a strip casting method or the like.

(b) The cast thin-strip-shaped ingot is crushed into alloy flakes.

(c) The alloy flakes are cooled.

Here, in order to prevent oxidation of R-T-B type alloys, the above steps (a) to (c) are usually performed under reduced pressure or under an inert gas atmosphere.

Casting through the strip casting method can be performed, for example, with the following steps.

(A) Raw materials are charged into a crucible and heated, thereby being melted into a molten R-T-B type alloy.

(B) This molten alloy is poured via a tundish onto a copper roll having a structure in which a coolant circulates.

(C) The molten alloy poured onto the copper roll is rapidly cooled and solidified, so that an ingot in a thin strip shape is cast.

The alloy flakes formed by the R-T-B type alloy have an alloy crystal structure in which a crystallinity phase (main phase) formed by an $R_2T_{14}B$ phase and an R-rich phase in which the rare earth element is concentrated coexist. The main phase is a ferromagnetic phase contributing to a magnetizing effect, and the R-rich phase is a non-magnetic phase not contributing to a magnetizing effect. The alloy crystal structure including the main phase and the R-rich phase can be evaluated using the crystal grain size of the main phase (hereinafter, referred to as a "main phase grain size") in a cross-section of the alloy flake cut in the thickness direction (a cross-section in the thickness direction). The main phase grain size in an alloy flake obtained by crushing an ingot cast by the strip casting method is typically 3 to 5 μm.

Meanwhile, the main phase grain size of alloy flakes can be coarsened by subjecting the alloy flakes to heat treatment of heating to and holding at a predetermined temperature for a predetermined time and then cooling under reduced pressure or under an inert gas atmosphere. Specifically, alloy flakes produced by the above steps (a) to (c) are subjected to a heat treatment in which the alloy flakes are heated and held for a predetermined time and then cooled, so that the main phase grain size can be coarsened.

Alternatively, the main phase grain size of alloy flakes can be coarsened by replacing the cooling (rapid cooling) treatment in (c) in the production of alloy flakes through the above-described steps (a) to (c) with a heat treatment in which the alloy flakes are heated to and held at a predetermined temperature for a predetermined time and then cooled. Specifically, high-temperature alloy flakes immediately after being made by crushing a cast ingot are subjected to heat treatment without being cooled, whereby the main phase grain size of the alloy flakes can be coarsened. The series of heat treatments in which high-temperature alloy flakes immediately after being made by crushing an ingot are heated to and held at a predetermined temperature for a predetermined time and then cooled is also referred to as a "slow cooling treatment," hereinafter.

To produce alloy flakes formed by R-T-B type alloys, various proposals have been made as shown in Patent Literatures 1 and 2, for example. An alloy flake production system described in Patent Literature 1 is configured by a melting and casting chamber in which alloy flakes are obtained by casting and the alloy flakes are placed on a conveyer, a heat treatment chamber in which the alloy flakes placed on the conveyer are heated while being transported, and a cooling chamber in which the alloy flakes are rapidly cooled to be discharged to atmospheric pressure. In the alloy flake production system described in Patent Literature 1, the melting and casting chamber, the heat treatment chamber, and the cooling chamber are connected through partitioning doors, thus allowing alloy flakes placed on the conveyer to be sequentially processed in a batch mode without being exposed to the atmosphere.

In an alloy flake production system described in Patent Literature 2, alloy flakes made by casting are dropped onto a dish-shaped container rotating at a low speed to be subjected to annealing. The alloy flakes dropped on the rotating dish-shaped container are allowed to spread over the entire surface of the dish-shaped container and stirred by a plurality of plowshares that is pressed against the surface of the dish-shaped container. In this way, the alloy flake production system described in Patent Literature 2 allows uniform heating treatment on the alloy flakes.

CITATION LIST

Patent Literature

PATENT LITERATURE 1: Japanese Patent Application Publication No. 2001-198664

PATENT LITERATURE 2: Japanese Patent Application Publication No. 2005-118850

SUMMARY OF THE INVENTION

Technical Problem

For alloy flakes formed by R-T-B type alloys, there is a demand for making the main phase grain size thereof, which is normally 3 to 5 μm, 10 μm or greater. The main phase grain size of alloy flakes can be coarsened by subjecting the alloy flakes immediately after being made by crushing an ingot to a heat treatment in which the alloy flakes are heated to and held at a predetermined temperature for a predetermined time and then cooled (slow cooling treatment) as described above. When the slow cooling treatment is provided for structure control, alloy flakes are heated uniformly while being stirred, whereby the crystal structure (main phase grain size) of the alloy flakes subjected to the slow cooling treatment can be in a desired state and can be in a homogeneous state (in which variation of the main phase grain size is reduced).

In the alloy flake production system described in Patent Literature 1, there is no description of uniformly heating alloy flakes while stirring them. Moreover, if the alloy flake production system described in Patent Literature 1 were used to uniformly heat alloy flakes while stirring them, a complicated mechanism would be required because alloy flakes are placed on the conveyer for transport.

In the alloy flake production system described in Patent Literature 2, the rotating dish-shaped container is used to apply heat treatment, and alloy flakes are spread over the entire surface of the dish-shaped container and heated. In the alloy flake production system described in Patent Literature 2, variations in temperature among the alloy flakes spread over the entire surface can occur between those located on the rotation center of the dish-shaped container and those located on the periphery. In this case, in order to provide uniform heating while preventing variations in temperature occurring in the radial direction, a heat-treatment control mechanism is required for making uniform heat-treatment conditions on the rotation center and on the periphery of the dish-shaped container, resulting in the need for a complicated production system.

The present invention has been made in view of these circumstances, and has an object of providing an alloy flake production apparatus capable of applying long-time heat treatment (slow cooling treatment) uniformly to alloy flakes immediately after being made by crushing an ingot, and a production method for raw material alloy flakes for a rare earth magnet using the apparatus.

Solution to Problem

The present inventors conducted various tests and diligently studied over and over to solve the above problems. As a result, they have found that long-time uniform heat treatment (slow cooling treatment) to alloy flakes immediately after being made by crushing an ingot is feasible without making the apparatus bulky and complicated if a heating drum for heating fed alloy flakes to a predetermined temperature has a device for switching between storage and discharge of the fed alloy flakes.

The present invention has been accomplished based on the above finding, and the summaries thereof are stated in (1) to (7) below relating to an alloy flake production apparatus and (8) and (9) below relating to a production method for raw material alloy flakes for a rare earth magnet.

(1) An alloy flake production apparatus, comprising: a crystallinity control device for controlling an alloy crystal structure of fed alloy flakes to a desired state; a cooling device for cooling alloy flakes discharged from the crystallinity control device; and a chamber for keeping the crystallinity control device and the cooling device under reduced pressure or under an inert gas atmosphere, the crystallinity control device including a rotary heating drum in a cylindrical shape for heating the fed alloy flakes, and a switching device for switching between storage and discharge of the alloy flakes fed to an inner wall side of the heating drum.

(2) The alloy flake production apparatus according to the above (1), in which the heating drum includes at least one scooping blade plate for scooping up the alloy flakes fed to the inner wall side with rotation thereof.

(3) The alloy flake production apparatus according to any one of the above (1) and (2), in which the switching device is a screw that allows the alloy flakes to be stored when rotated in one direction, and allows the alloy flakes to be discharged when rotated in another direction opposite to the one direction.

(4) The alloy flake production apparatus according to any one of the above (1) and (2), in which the switching device is a lid that is provided at a discharge side of the heating drum and includes an opening and closing mechanism.

(5) The alloy flake production apparatus according to any one of the above (1) to (4), in which the cooling device includes a rotary cooling drum in a cylindrical shape, the cooling drum having a structure in which a coolant circulates.

(6) The alloy flake production apparatus according to the above (5), in which the cooling drum includes fins at an inner wall of the cooling drum for cooling fed alloy flakes, a cooling shaft provided at a position of the rotation axis and having a structure in which a coolant circulates, and fins at an outer wall of the cooling shaft for cooling the fed alloy flakes.

(7) The alloy flake production apparatus according to any one of the above (1) to (4), in which the cooling device includes a rotary cooling body, the cooling body having a structure in which a coolant circulates and being provided, at predetermined angular intervals, with a plurality of cooling chambers having a polygonal cross-sectional shape and extending therethrough in the direction of the rotation axis.

(8) A production method for raw material alloy flakes for a rare earth magnet, comprising: under reduced pressure or under an inert gas atmosphere, casting an ingot from a molten R-T-B type alloy through a strip casting method; heating alloy flakes made by crushing the ingot to a predetermined temperature; holding the alloy flakes at the predetermined temperature for a predetermined time; and then cooling the alloy flakes. When the alloy flakes are heated to and held at the predetermined temperature for the predetermined time and then cooled, the alloy flakes are heated to and held at a temperature of 800° C. or higher and lower than 1100° C. for at least 20 minutes, or heated to and held at a temperature of 1100° C. or higher for at least 8 minutes, and then cooled.

(9) A production method for raw material alloy flakes for a rare earth magnet, comprising: under reduced pressure or under an inert gas atmosphere, casting an ingot from a molten R-T-B type alloy through a strip casting method; heating alloy flakes made by crushing the ingot to a predetermined temperature; holding the alloy flakes at the predetermined temperature for a predetermined time; and then cooling the alloy flakes. When the alloy flakes are heated to and held at the predetermined temperature for the predetermined time and then cooled, the alloy flake production apparatus according to any one of the above (1) to (7) is used.

(10) The production method for raw material alloy flakes for a rare earth magnet according to the above (8), in which when the alloy flakes are heated to and held at a temperature of 800° C. or higher and lower than 1100° C. for at least 20 minutes, or heated to and held at a temperature of 1100° C. or higher for at least 8 minutes, and then cooled, the alloy flake production apparatus according to any one of the above (1) to (7) is used.

Advantageous Effects of Invention

An alloy flake production apparatus of the present invention includes a crystallinity control device having a device for switching between storage and discharge of fed alloy flakes, thus being able to heat and hold the alloy flakes to and at a predetermined temperature for any length of time without changing the apparatus configuration. With this, the alloy flake production apparatus of the present invention can apply long-time heat treatment uniformly to the alloy flakes immediately after being made by crushing an ingot. Moreover, the alloy flake production apparatus of the present invention is not limited to long-time heat treatment and alloy flakes formed by R-T-B type alloys, but can apply heat treatment uniformly to various types of alloy flakes under various time conditions.

In a production method for raw material alloy flakes for a rare earth magnet of the present invention, alloy flakes with a main phase grain size of 10 μm or greater can be efficiently produced by casting a thin-strip-shaped ingot from a molten R-T-B type alloy through a strip casting method, and subjecting alloy flakes made by crushing the ingot to heat treatment (slow cooling treatment) which includes heating to and holding at a temperature of 800° C. or higher and lower than 1100° C. for at least 20 minutes, or heating to and holding at a temperature of 1100° C. or higher for at least 8 minutes, and then cooling. Moreover, use of the above-described alloy flake production apparatus of the present invention when performing heat treatment (slow cooling treatment) enables uniform heat treatment of alloy flakes under various time conditions.

DESCRIPTION OF EMBODIMENTS

Hereinafter, an alloy flake production apparatus of the present invention and a production method for raw material alloy flakes for a rare earth magnet using the apparatus will be described with reference to the drawings.

[Alloy Flake Production Apparatus]

Figure 1:
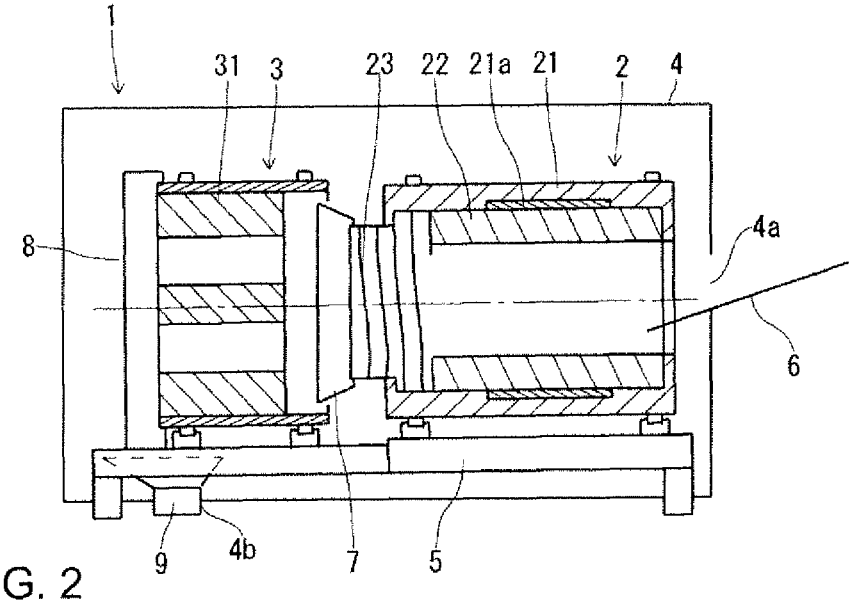
FIG. 1 is a schematic diagram illustrating a configuration example of an alloy flake production apparatus of the present invention.

FIG. 1 is a schematic diagram illustrating a configuration example of an alloy flake production apparatus of the present invention. An alloy flake production apparatus 1 shown in the figure includes a crystallinity control device 2 for controlling an alloy crystal structure of fed alloy flakes to a desired state, a cooling device 3 for cooling the alloy flakes discharged from the crystallinity control device 2, and a chamber 4 housing the crystallinity control device 2 and the cooling device 3 for keeping them under reduced pressure or under an inert gas atmosphere. The crystallinity control device 2 and the cooling device 3 are rotatably supported on a bed 5. The chamber 4 has a feed port 4*a* and a discharge port 4*b* for feeding and discharging the alloy flakes.

The inlet 4*a* is provided with an entry-side guide 6 for guiding the fed alloy flakes into the crystallinity control device 2. Moreover, an intermediate guide 7 for guiding the alloy flakes discharged from the crystallinity control device 2 to the cooling device 3 is provided between the crystallinity control device 2 and the cooling device 3. Further, to discharge alloy flakes discharged from the cooling device 3 to the outside of the chamber 4, an exit-side guide 8 is provided at the exit side of the cooling device 3 and a hopper 9 is provided at the outlet 4*b*.

The alloy flake production apparatus of the present invention includes the crystallinity control device 2 for controlling the alloy crystal structure of fed alloy flakes to a desired state, the cooling device 3 for cooling the alloy flakes discharged from the crystallinity control device, and the chamber 4 for keeping them under reduced pressure or under an inert gas atmosphere. In the alloy flake production apparatus, the crystallinity control device 2 includes a rotary heating drum 21 in a cylindrical shape for heating the fed alloy flakes and a switching device for switching between storage and discharge of the alloy flakes fed to an inner-wall side of the heating drum 21.

The crystallinity control device 2 includes the heating drum 21 and the switching device for switching between storage and discharge of the alloy flakes fed to the heating drum 21. This makes it possible to discharge the alloy flakes from the heating drum after storing them in the heating drum 21 for any length of time by operation of the switching device. Thus, the alloy flake production apparatus of the present invention is capable of applying heat treatment to alloy flakes in which the alloy flakes are heated to and held at an elevated temperature for a long time without making the heating drum longer and making the apparatus larger or without providing a turn-back mechanism, which makes the apparatus complicated. Moreover, since alloy flakes are stirred with rotation of the heating drum 21, the alloy flakes can be heated uniformly, which makes the alloy flakes subjected to the heat treatment homogeneous.

When the alloy flakes are fed to the inner-wall side of the heating drum 21 with the rotation axis being horizontal or inclined, and heated to an elevated temperature by a heating device such as a heater 21*a* provided on the wall surface, the fed alloy flakes are accumulated into layers in the heating drum. When the heating drum is rotated in this state, the alloy flakes accumulated into layers only move in a mass while sliding. As a result, a temperature difference is generated between upper and lower portions in the mass of the alloy flakes accumulated into layers, and a temperature difference is also generated in a single alloy flake between a side contacting the inner wall surface of the heating drum and the other side.

Because of this, in the alloy flake production apparatus of the present invention, the heating drum 21 preferably has, at its inner wall side, at least one scooping blade plate 22 for scooping up the fed alloy flakes with its rotation. In the alloy flake production apparatus 1 shown in FIG. 1, the heating drum 21 has two scooping blade plates 22 in a rectangular shape provided perpendicularly to the inner wall. Alloy flakes accumulated into layers are scooped up by these scooping blade plates 22 with the rotation of the heating drum 21, and then fall down. During this, each alloy flake may change its location in the mass of the alloy flakes accumulated into layers, and the alloy flakes are turned inside out so that the contact surface of each alloy flake contacting the inner wall surface of the heating drum changes. As a result, the fed alloy flakes can be heated more uniformly, and the alloy flakes subjected to the heat treatment can be more homogeneous.

As the switching device for switching between storage and discharge of the alloy flakes fed to the heating drum 21, for example, an embodiment in which a lid having an opening and closing mechanism is provided at the discharge side of the heating drum can be employed. In this case, there is a concern that the alloy flakes may get stuck when the lid is opened and closed, or that a fine powder produced from the alloy flakes coming into contact with some members or the like when moving may adhere to a sliding portion of the opening and closing mechanism, thereby causing trouble.

Therefore, in the alloy flake production apparatus of the present invention, as the switching device, as shown in FIG. 1, it is preferable to employ a screw 23 that allows the alloy flakes to be stored when rotated in one direction and allows them to be discharged when rotated in the other direction opposite to the one direction. For example, as shown in the figure, the screw 23 may be formed by a spirally continuous fin provided at a portion of the discharge side of the inner wall of the heating drum 21. This can dispel the above-described concern about trouble caused by the alloy flakes getting stuck or adhesion of a fine powder to the sliding portion.

The heating drum 21 may be provided with the rotation axis slightly inclined from a horizontal position so that when the alloy flakes are discharged from the heating drum 21 to the cooling device via the switching device, the discharge is performed smoothly. The angle of inclination of the rotation axis may be in a degree sufficient to achieve the above object, and is generally 1 to 5° from the horizontal position.

The alloy flake production apparatus of the present invention includes the cooling device 3, and the cooling device 3 may include a rotary cooling drum 31 in a cylindrical shape which has a structure in which a coolant circulates. In this case, the cooling drum 31 preferably has fins at its inner wall of the cooling drum 31 for cooling fed alloy flakes, a cooling shaft provided at a position of the rotation axis and having a structure in which a coolant circulates, and fins at the outer wall of the cooling shaft for cooling the fed alloy flakes.

Figure 2:
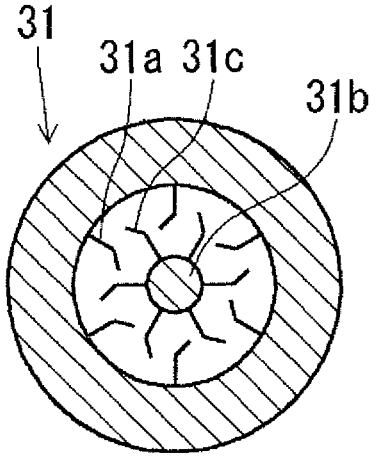
FIG. 2 is a cross-sectional view schematically showing a cooling drum provided with cooling fins.

FIG. 2 is a cross-sectional view schematically showing a cooling drum provided with cooling fins. The cooling drum 31 shown in the figure has a rotary cooling shaft 31*b* provided at the position of the rotation axis of the cooling drum 31, and the cooing shaft 31*b* has a structure in which a coolant circulates although not shown in the figure. The cooling drum 31 also has drum-side fins 31*a* for cooling the alloy flakes fed to the drum inner wall, and has shaft-side fins 31*c* for cooling the alloy flakes fed to the shaft outer wall.

The alloy flakes fed to the cooling drum 31 with this configuration move along the drum inner wall and are lifted along the drum-side fins 31*a*, and then fall. At this time, the alloy flakes fall, contacting the shaft-side fins 31*c* and the outer wall of the cooling shaft. Thus the alloy flakes come into contact with the drum-side fins 31*a*, the shaft-side fins 31*c*, and the outer wall of the cooling shaft 31*b*, as well as the inner wall of the cooling drum. Therefore, the alloy flakes can be efficiently cooled.

Moreover, in the cooling drum, a temperature difference between the alloy flakes and the contact surfaces such as those of the cooling fins causes heat exchange, thereby cooling the alloy flakes. Since the cooling drum 31 has the cooling shaft 31*b*, the drum-side fins 31*a*, and the shaft-side fins 31*c*, surfaces in contact with the alloy flakes change with rotation, so that an invariably stable temperature gradient and cooling rate are achieved.

The alloy flake production apparatus of the present invention includes the cooling device, and the cooling device may include a rotary cooling body which has a structure in which a coolant circulates and is provided, at predetermined angular intervals, with a plurality of cooling chambers having a polygonal cross-sectional shape and extending therethrough in the direction of the rotation axis.

Figure 3:
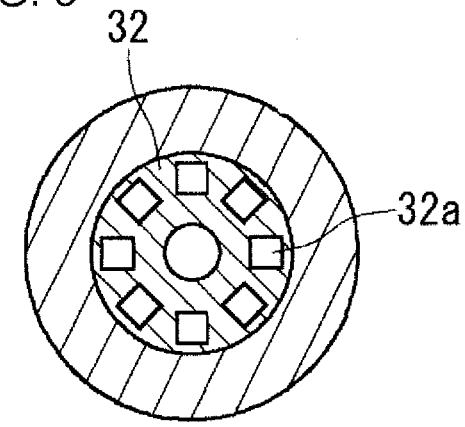
FIG. 3 is a cross-sectional view schematically showing a cooling body that can be used as a cooling device.

FIG. 3 is a cross-sectional view schematically showing a cooling body that can be used as the cooling device. The cooling body 32 shown in the figure is provided, at equiangular intervals, with eight cooling chambers 32*a* having a quadrangular cross-sectional shape and extending therethrough in the direction of the rotation axis, and has a structure in which a coolant circulates (not shown).

When alloy flakes are fed to the cooling body 32 with this configuration, the alloy flakes are fed into the plurality of cooling chambers 32*a* in a distributed manner, so that areas of contact of the alloy flakes with the cooling body 32 can be increased. Moreover, rotating the plurality of cooling chambers 32*a* with the rotation of the cooling body 32 can turn the alloy flakes inside out and can change their locations in the alloy flake masses since the cross-sectional shape of the cooling chambers 32*a* is a polygonal shape. With these, the alloy flakes can be efficiently cooled, and an invariably stable temperature gradient and cooling rate can be achieved.

In the alloy flake production apparatus of the present invention, the cooling drum or the cooling body may be provided with the rotation axis slightly inclined from the horizontal position so that the alloy flakes that are fed to the feed side of the cooling drum or the cooling body are smoothly guided to a discharge portion of the cooling drum. The inclination angle of the rotation axis may be in a degree sufficient to achieve the above object, and is generally 1 to 5° from the horizontal position.

The alloy flake production apparatus of the present invention can be used for heat treatment of alloy flakes that are cast through the strip casting method and crushed as well as alloy flakes made through various atomizing methods. When used for heat treatment of alloy flakes made by casting a molten R-T-B type alloy and crushing it, the alloy flake production apparatus of the present invention can be used both for heat treatment of alloy flakes that are cooled to room temperature after crushing, and for heat treatment (slow cooling treatment) of high-temperature alloy flakes immediately after crushing.

Moreover, the alloy flake production apparatus of the present invention can heat and hold alloy flakes to and at a predetermined temperature for any length of time without the need to change the apparatus configuration, and thus can uniformly apply long-time heat treatment as well as heat treatment under various time conditions to the alloy flakes. When this alloy flake production apparatus of the present invention is used to apply heat treatment to high-temperature alloy flakes immediately after being made by casting a molten R-T-B type alloy and crushing it, production of alloy flakes with a main phase grain size of 10 μm or greater and production of alloy flakes with a main phase grain size of 3 to 5 μm can be easily switched by operation of the switching device.

[Production Method for Raw Material Alloy Flakes for a Rare Earth Magnet]

A production method for raw material alloy flakes for a rare earth magnet of the present invention includes, under reduced pressure or under an inert gas atmosphere, casting an ingot from a molten R-T-B type alloy through a strip casting method, heating and holding alloy flakes made by crushing the ingot to and at a predetermined temperature for a predetermined time and then cooling them. In the production method for raw material alloy flakes for a rare earth magnet, when the alloy flakes are heated to and held at a predetermined temperature for a predetermined time and then cooled, the alloy flakes are heated to and held at a temperature of 800° C. or higher and lower than 1100° C. for at least 20 minutes, or are heated to and held at a temperature of 1100° C. or higher for at least 8 minutes, and then cooled.

In the production method for raw material alloy flakes for a rare earth magnet of the present invention, heat treatment (slow cooling treatment) is applied to high-temperature alloy flakes immediately after crushing, and thereby it is possible to efficiently coarsen the main phase grain size of the alloy flakes and to facilitate control of the main phase grain size. Therefore, the production method for raw material alloy flakes for a rare earth magnet of the present invention allows efficient production of alloy flakes with a main phase grain size of 10 μm or greater.

When alloy flakes with a main phase grain size of 20 μm or greater are produced with the production method for raw material alloy flakes for a rare earth magnet of the present invention, it is preferable that when alloy flakes are heated to and held at a predetermined temperature for a predetermined time and then cooled, the alloy flakes be heated to and held at a temperature of 800° C. or higher and lower than 1100° C. for at least 60 minutes, or heated to and held at a temperature of 1100° C. or higher for at least 20 minutes.

In the production method for raw material alloy flakes for a rare earth magnet of the present invention, the upper limit of time for which alloy flakes heated to a predetermined temperature are held can be set appropriately in accordance with a main phase grain size required for the alloy flakes. When alloy flakes are heated to a temperature of 1100° C. or higher in the production method for raw material alloy flakes for a rare earth magnet of the present invention, it is preferable that the heating temperature of the alloy flakes be lower than the melting point of the alloy flakes in terms of preventing the alloy flakes from fusing and deteriorating quality.

It is preferable, in the production method for raw material alloy flakes for a rare earth magnet of the present invention, to use the above-described alloy flake production apparatus of the present invention when the alloy flakes are heated to and held at the above-described temperatures for the above-described lengths of time and then cooled. The alloy flake production apparatus of the present invention enables production of alloy flakes with a main phase grain size of 10 μm or greater with reduced equipment costs.

Meanwhile, another embodiment of a production method for raw material alloy flakes for a rare earth magnet of the present invention includes, under reduced pressure or under an inert gas atmosphere, casting an ingot from a molten R-T-B type alloy through a strip casting method, heating and holding alloy flakes made by crushing the ingot to and at a predetermined temperature for a predetermined time and then cooling them. When heating and holding alloy flakes to and at the predetermined temperature for the predetermined time and then cooling, the production method for raw material alloy flakes for a rare earth magnet uses the above-described alloy flake production apparatus of the present invention. This enables uniform heat treatment of the alloy flakes under various time conditions.

Examples

In order to verify the effects of the alloy flake production apparatus and the production method for raw material alloy flakes for a rare earth magnet using the apparatus of the present invention, the following tests were performed.

[Test Method]

In the tests, an ingot in a thin strip shape was cast from a molten R-T-B type alloy heated to 1600° C. by the above-described ingot casting steps of the strip casting method, and the ingot was crushed into alloy flakes. The cast thin-strip-shaped ingot had a width of 250 mm and a thickness of 0.3 mm. The casting conditions were such that the amount of molten alloy pored was 35 kg/min and the peripheral velocity of a water-cooled roll was 70 m/sec. The molten R-T-B type alloy was made of metallic neodymium, electrolytic iron, and ferroboron with the typical composition being Fe: 65.5% by mass, Nd: 20.9% by mass, and B: 0.96% by mass.

In Example 1, without being cooled to room temperature, the alloy flakes immediately after being made by crushing an ingot were subjected to a slow cooling treatment of heating to and holding at 900° C. for 30 minutes and then cooling. For the slow cooling treatment, the heating drum for heating the fed alloy flakes and the cooling drum for cooling the fed alloy flakes were used.

The alloy flakes subjected to the slow cooling treatment were subjected to a heat treatment of heating to and holding at a treatment temperature for a predetermined time and then cooling, using the alloy flake production apparatus shown in FIG. 1. Under conditions A to C, the treatment temperatures were 900° C., 1040° C., and 1100° C., respectively, and the time of heating to and holding at the treatment temperature (hereinafter, also simply referred to as a "treatment time") was 30 minutes in each condition. Under conditions D and E, the treatment temperature was 1040° C. in each condition, and the treatment times were 15 minutes and 60 minutes, respectively.

In Comparative Example 1, as in Example 1, without being cooled to room temperature, the alloy flakes immediately after being made by crushing an ingot were subjected to a slow cooling treatment of heating to and holding at 900° C. for 40 minutes and then cooling. In Comparative Example 1, these alloy flakes were not subjected to the heat treatment of heating to and holding at a treatment temperature for a predetermined time and then cooling.

In Example 2, the alloy flakes immediately after being made by crushing an ingot were subjected to a rapid cooling treatment of cooling without being heated to and held at a predetermined temperature. These alloy flakes were subjected to the heat treatment of heating to and holding at a treatment temperature for a predetermined time and then cooling, using the alloy flake production apparatus shown in FIG. 1. Under conditions F to H, the treatment temperatures were 900° C., 1040° C., and 1100° C., respectively, and the treatment time was 30 minutes in each condition. Under conditions I and J, the treatment temperature was 1040° C. in each condition, and the treatment times were 15 minutes and 60 minutes, respectively.

In Comparative Example 2, as in Example 2, the alloy flakes immediately after being made by crushing an ingot were subjected to the rapid cooling treatment of cooling without being heated to and held at a predetermined temperature. In Comparative Example 2, these alloy flakes were not subjected to the heat treatment of heating to and holding at a treatment temperature for a predetermined time and then cooling.

In Example 3, without being cooled to room temperature, the alloy flakes immediately after being made by crushing an ingot were subjected to the heat treatment (slow cooling treatment) of heating to and holding at a treatment temperature for a treatment time and then cooling, using the alloy flake production apparatus shown in FIG. 1. Under condition K, the alloy flakes were subjected to a heat treatment (slow cooling treatment) of heating to and holding at 960° C. for 60 minutes and then cooling. Under conditions L and M, the treatment temperature was 800° C. in each condition, and the treatment times were 20 minutes and 60 minutes, respectively. Under conditions N and O, the treatment temperature was 1100° C. in each condition, and the treatment times were 10 minutes and 20 minutes, respectively.

Casting of ingots by the strip casting method, crushing of them and the heat treatment in Examples 1 to 3 were all performed under an atmosphere filled with argon, an inert gas, at 0.2 atm. In the alloy flake production apparatus shown in FIG. 1 used in Examples 1 to 3, the cooling device was the cooling drum having the cooling fins shown in FIG. 2, and the coolant was cooling water.

[Evaluation Indicator]

The main phase grain sizes of the alloy flakes subjected to the heat treatment under each condition were measured. The measurement of the main phase grain sizes was performed by the following steps.

(1) Five resultant alloy flakes were taken, embedded in resin and polished so that cross-sections thereof in the thickness direction can be observed. Then, using a scanning electron microscope, reflected electron images of the alloy flakes were taken by 150 times magnification.

(2) The reflected electron image photographs taken were imported into an image analyzer to perform binarization processing on R-rich phases and main phases based on brightness.

(3) A straight line parallel to a surface that contacted a rapid-cooling roll was drawn at a central position in the thickness direction of each alloy flake, and the widths of ten main phases (intervals between adjacent R-rich phases) on the straight line were measured in each alloy flake to calculate the mean value.

[Test Results]

Table 1 shows types of treatments performed immediately after cast ingots were crushed into alloy flakes, conditions of the heat treatment provided by the alloy flake production apparatus of the present invention, and main phase grain sizes measured, under conditions in Examples 1 to 3.

treatment were subjected to the heat treatment by the alloy flake production apparatus of the present invention under each condition, the main phase grain sizes were coarsened to 13.6 to 37.3 μm. Under conditions B to E in Example 1, the treatment temperature was 1040° C. or higher, and the treatment time was at least 15 minutes, whereby the main phase grain sizes became 20 μm or greater.

In Comparative Example 2, in which alloy flakes subjected to the rapid cooling treatment were not subjected to the heat treatment by the alloy flake production apparatus of the present invention, the main phase grain size was 3.3 μm. In Example 2, in which alloy flakes subjected to the rapid cooling treatment were subjected to the heat treatment by the alloy flake production apparatus of the present invention under each condition, the main phase grain sizes were coarsened to 11.6 to 22.8 μm. Under condition H in Example 2, the treatment temperature was 1100° C., and the treatment time was 30 minutes, whereby the main phase grain size became 20 μm or greater.

In Example 3, alloy flakes immediately after being made by crushing an ingot were subjected to the heat treatment (slow cooling treatment) by the alloy flake production apparatus of the present invention. Under conditions L and N in Example 3, the main phase grain sizes were 11.0 μm and 13.0 μm, respectively. From this, it has been found that by casting a thin-strip-shaped ingot from a molten R-T-B type alloy by the strip casting method, subjecting the alloy flakes made by crushing the ingot to the heat treatment (slow cooling treatment) of heating to and holding at a temperature of 800° C. or higher and lower than 1100° C. for at least 20 minutes, or heating to and holding at a temperature of 1100° C. or higher for at least 8 minutes, and then cooling, the main phase grain size of the resultant alloy flakes can be 10 μm or greater.

TABLE 1

| | | | Heat Treatment by an Apparatus of the Present Invention | | |
|---|---|---|---|---|---|
| Category | Condition | Treatment Immediately After Crushing | Treatment Temperature (° C.) | Treatment Time (min.) | Main Phase Grain Size (μm) |
| Example 1 | A | Slow cooling treatment | 900 | 30 | 13.6 |
| | B | Slow cooling treatment | 1040 | 30 | 29.2 |
| | C | Slow cooling treatment | 1100 | 30 | 37.3 |
| | D | Slow cooling treatment | 1040 | 15 | 23.5 |
| | E | Slow cooling treatment | 1040 | 60 | 32.7 |
| Comparative Example 1 | — | Slow cooling treatment | — | — | 3.8 |
| Example 2 | F | Rapid cooling treatment | 900 | 30 | 11.6 |
| | G | Rapid cooling treatment | 1040 | 30 | 16.4 |
| | H | Rapid cooling treatment | 1100 | 30 | 22.8 |
| | I | Rapid cooling treatment | 1040 | 15 | 16.5 |
| | J | Rapid cooling treatment | 1040 | 60 | 18.7 |
| Comparative Example 2 | — | Rapid cooling treatment | — | — | 3.3 |
| Example 3 | K | None | 960 | 60 | 23.0 |
| | L | None | 800 | 20 | 11.0 |
| | M | None | 800 | 60 | 20.0 |
| | N | None | 1100 | 10 | 13.0 |
| | O | None | 1100 | 20 | 20.0 |

*) "None" in the column "Treatment Immediately After Crushing" means that alloy flakes immediately after crushing were directly subjected to heat treatment by the alloy flake production apparatus of the present invention.

The results shown in Table 1 indicate that, in Comparative Example 1, in which alloy flakes subjected to the slow cooling treatment were not subjected to the heat treatment by the alloy flake production apparatus of the present invention, the main phase grain size was 3.8 μm. In Example 1, in which alloy flakes subjected to the slow cooling Under conditions K, M, and O in Example 3, the main phase grain size was 20.0 μm or greater in each condition. From this, it has been found that by heating and holding alloy flakes to and at a temperature of 800° C. or higher and lower than 1100° C. for at least 60 minutes, or heating and holding them to and at a temperature of 1100° C. or higher for at least 20 minutes, the main phase grain size of the resultant alloy flakes can be 20 μm or greater.

INDUSTRIAL APPLICABILITY

In the alloy flake production apparatus of the present invention, the crystallinity control device includes the device for switching between storage and discharge of fed alloy flakes, whereby without changing the apparatus configuration, the alloy flakes can be heated to and held at a predetermined temperature for any length of time. Thus, the alloy flake production apparatus of the present invention can apply long-time heat treatment uniformly to the alloy flakes immediately after being made by crushing an ingot. Moreover, the alloy flake production apparatus of the present invention is not limited to long-time heat treatment and alloy flakes made from R-T-B type alloys, but can provide heat treatment uniformly to various types of alloy flakes under various time conditions.

In the production method for raw material alloy flakes for a rare earth magnet of the present invention, alloy flakes with a main phase grain size of 10 μm or greater can be efficiently produced by casting a thin-strip-shaped ingot from a molten R-T-B type alloy through a strip casting method, subjecting the alloy flakes made by crushing the ingot to a heat treatment (slow cooling treatment) of heating to and holding at a temperature of 800° C. or higher and lower than 1100° C. for at least 20 minutes, or heating to and holding at a temperature of 1100° C. or higher for at least 8 minutes, and then cooling. Moreover, using the above-described alloy flake production apparatus of the present invention to perform heat treatment (slow cooling treatment), the heat treatment can be uniformly applied to alloy flakes under various time conditions.

Accordingly, the alloy flake production apparatus and the production method for raw material alloy flakes for a rare earth magnet using the apparatus of the present invention can provide alloy flakes suitable for use as a raw material of rare earth sintered magnets.

REFERENCE SIGNS LIST

1: Alloy flake production apparatus
2: Crystallinity control device
3: Cooling device
4: Chamber
4*a*: Alloy flake feed port
4*b*: Alloy flake discharge port
5: Bed
6: Entry-side guide
7: Intermediate guide
8: Exit-side guide
9: Hopper
21: Rotary heating drum
21*a*: heater
22: Scooping blade plate
23: Screw
31: Rotary cooling drum
31*a*: Drum-side cooling fin
31*b*: Cooling shaft
31*c*: Shaft-side cooling fin
32: Cooling body
32*a*: Cooling chamber

What is claimed is:

1. An alloy flake production apparatus, comprising:

a crystallinity control device for controlling an alloy crystal structure of fed alloy flakes to a desired state;

a cooling device for cooling alloy flakes discharged from the crystallinity control device; and a chamber for keeping the crystallinity control device and the cooling device under reduced pressure or under an inert gas atmosphere, the crystallinity control device including a rotary heating drum in a cylindrical shape for heating the fed alloy flakes, and a switching device for switching between storage and discharge of the alloy flakes fed to an inner wall side of the heating drum, the switching device being provided between a discharge side of the heating drum and an entry end of the cooling device, wherein the cooling device includes a rotary cooling body, the rotary cooling body having a structure in which a coolant circulates and being provided, at equiangular intervals, with a plurality of cooling chambers having a polygonal cross-sectional shape and extending therethrough in a direction of a rotation axis; wherein the switching device is a lid including an opening and closing mechanism.

2. The alloy flake production apparatus according to claim 1, wherein the heating drum includes at least one scooping blade plate for scooping up the alloy flakes fed to the inner wall side with rotation thereof.

3. The alloy flake production apparatus according to claim 1, wherein the switching device is a screw that allows the alloy flakes to be stored when rotated in one direction, and allows the alloy flakes to be discharged when rotated in the other direction opposite to the one direction.

4. The alloy flake production apparatus according to claim 2, wherein the switching device is a screw that allows the alloy flakes to be stored when rotated in one direction, and allows the alloy flakes to be discharged when rotated in the other direction opposite to the one direction.

* * * * *